US009266696B2

(12) United States Patent
Ogawa et al.

(10) Patent No.: US 9,266,696 B2
(45) Date of Patent: Feb. 23, 2016

(54) CONVEYANCE CONTROL APPARATUS

(71) Applicant: RISO KAGAKU CORPORATION, Minato-ku, Tokyo (JP)

(72) Inventors: Hideaki Ogawa, Tsukuba (JP); Yoshihiro Hanamoto, Tsukuba (JP); Yoshikazu Hara, Tsukuba (JP); Kazuaki Mori, Tsukuba (JP); Hiroaki Takanohashi, Tsukuba (JP); Yousuke Minowa, Tsukuba (JP); Yoshiaki Kono, Tsukuba (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 14/309,697

(22) Filed: Jun. 19, 2014

(65) Prior Publication Data

US 2015/0005925 A1 Jan. 1, 2015

(30) Foreign Application Priority Data

Jun. 28, 2013 (JP) ..... 2013-137232

(51) Int. Cl.

| | |
|---|---|
| ***G06F 7/00*** | (2006.01) |
| ***B65H 43/06*** | (2006.01) |
| ***B65H 31/02*** | (2006.01) |

(52) U.S. Cl.

CPC ..... *B65H 43/06* (2013.01); *B65H 31/02* (2013.01); *B65H 2301/4212* (2013.01); *B65H 2511/30* (2013.01); *B65H 2513/50* (2013.01); *B65H 2513/512* (2013.01); *B65H 2601/421* (2013.01); *B65H 2801/06* (2013.01)

(58) Field of Classification Search

CPC ..... A01B 12/006; B65H 2513/50
USPC ..... 700/218, 219
See application file for complete search history.

(56) References Cited

U.S. PATENT DOCUMENTS

| | | | | |
|---|---|---|---|---|
| 7,976,018 | B2 | 7/2011 | Ueda | |
| 2010/0066005 | A1 * | 3/2010 | Ueda | 271/3.17 |

FOREIGN PATENT DOCUMENTS

| | | | |
|---|---|---|---|
| JP | 2010089962 | A | 4/2010 |

* cited by examiner

*Primary Examiner* — Kyle Logan
(74) *Attorney, Agent, or Firm* — Holtz, Holtz & Volek PC

(57) ABSTRACT

A conveyance control apparatus includes a stacking base that stacks ejected paper sheets, a sensor that detects a paper sheet after the paper sheet is ejected according to job data before the paper sheet is stacked on the stacking base, a detection time measuring unit that measures sensor-on time during which the sensor detects the paper sheet, a storage unit that stores near-full-stack time for judging whether stacked volume on the stacking base enters into a near-full-stack state, a judging unit that judges stack state on the stacking base based on paper sheet information of the job data and a measured result by the detection time measuring unit, and a conveyance control unit that performs control to temporarily stop paper sheet feeding and then to feed predetermined number of paper sheets, when the judging unit judges that the sensor-on time is equal to or greater than the near-full-stack time.

3 Claims, 6 Drawing Sheets

CONVEYANCE CONTROL APPARATUS

CROSS-REFERENCE TO RELATED APPLICATIONS

This application is based upon and claims the benefit of priority of the prior Japanese Patent Application No. 2013-137232, filed on Jun. 28, 2013, the entire contents of which are incorporated herein by reference.

TECHNICAL FIELD

The present invention is related to a conveyance control apparatus applied to a printing device, such as a printer.

BACKGROUND ARTS

An ink-jet printer is an example of a printing device. Paper sheets after being printed by an ink-jet printer are ejected onto a paper sheet eject tray. When the paper sheets are in almost a full stack on the paper sheet eject tray, this state is detected as a near-full-stack state (near-full), and a user is warned of this state. When paper sheets are further ejected after being stacked up to the near-full state, the paper sheet eject tray will enter into the full-stack state. When the paper sheet stack tray is in the full-stack state, printing is interrupted. Then, a warning is given again to the user, and the printing is resumed after the paper sheets are removed from the paper sheet eject tray.

Here, when the paper sheets continue to be ejected further after the near-full state was detected, it is sometimes judged that the paper sheet eject tray is in the full-stack state, even though the paper sheet stack tray is not actually in the full-stack state. On this occasion, the printing is interrupted even though the printing device is still capable of stacking further paper sheets, and therefore productivity is reduced.

In view of the foregoing, a technology is disclosed in Patent Document 1 for recognizing a type of paper sheet, a residual capacity of a paper sheet eject base, or the like, and for calculating the number of remaining printable paper sheets so as to prevent printing from being interrupted during the printing of printing job data. In the technology described in Patent Document 1, a falling speed influenced by air resistance, or the like, is considered, and a stacking capacity on the paper sheet eject tray is estimated.

[Patent Document 1] Japanese Laid-Open Patent Publication No. 2010-89962

SUMMARY OF THE INVENTION

Paper sheets are stacked from a paper sheet feeding outlet of the ink-jet printer at a fixed speed, and fall freely on the paper sheet eject tray. While a stacked volume on the paper sheet eject tray is small, the paper sheets that are ejected from the paper sheet outlet fall on the paper sheet eject tray at a high speed.

However, when the stacked volume on the paper sheet eject tray becomes large, the influence of air resistance or the like on the freely falling paper sheets becomes large. As a result, when the stacking amount is large, the falling speed of the paper sheet is low. Particularly, in the near-full state, the falling speed of the paper sheet is remarkably low.

In the technology described in Patent Document 1, the falling speed influenced by air resistance or the like is considered, and a residual allowable stacking capacity to the near-full state is estimated. However, because the residual capacity is merely estimated by calculating a pulse width for each type of paper sheet (a size, weight, shape, or the like, of the paper sheet), the paper sheets are stacked without considering the influence of a stacking misalignment, or the like. Therefore, it is difficult to accurately judge the full-stack state. In particular, when the falling speed of the paper sheet is remarkably low, ejected paper sheets come into contact with each other, which is likely to result in stacking misalignment. In addition, the residual allowable stacking volume at the near-full state is merely an estimation, and therefore the residual allowable stacking amount sometimes has some margin with respect to an actual full-stack state.

The present invention aims at simply and accurately judging the stacked volume of the paper sheet on a paper sheet eject base.

According to one aspect, a conveyance control apparatus includes a stacking base that stacks ejected paper sheets, a sensor that detects a paper sheet after the paper sheet is ejected according to job data before the paper sheet is stacked on the stacking base, a detection time measuring unit that measures a sensor-on time during which the sensor detects the paper sheet, a storage unit that stores a near-full-stack time for judging whether or not a stacked volume on the stacking base enters into a near-full-stack state, a judging unit that judges a stack state on the stacking base on the basis of paper sheet information of the job data and a measured result by the detection time measuring unit, and a conveyance control unit that performs control to temporarily stop paper sheet feeding and then to feed a predetermined number of paper sheets, when the judging unit judges that the sensor-on time is equal to or greater than the near-full-stack time.

According to the above aspect, when the sensor-on time is equal to or greater than the near-full-stack time, the feeding of a paper sheet is temporarily stopped. As a result, even if the paper sheet is influenced by air resistance or the like, because the paper sheet deviates from a detection range of the sensor, it is possible to accurately judge whether or not the stacked volume is in the full-stack state regardless of the stacking misalignment.

DESCRIPTION OF THE EMBODIMENTS

Figure 1:
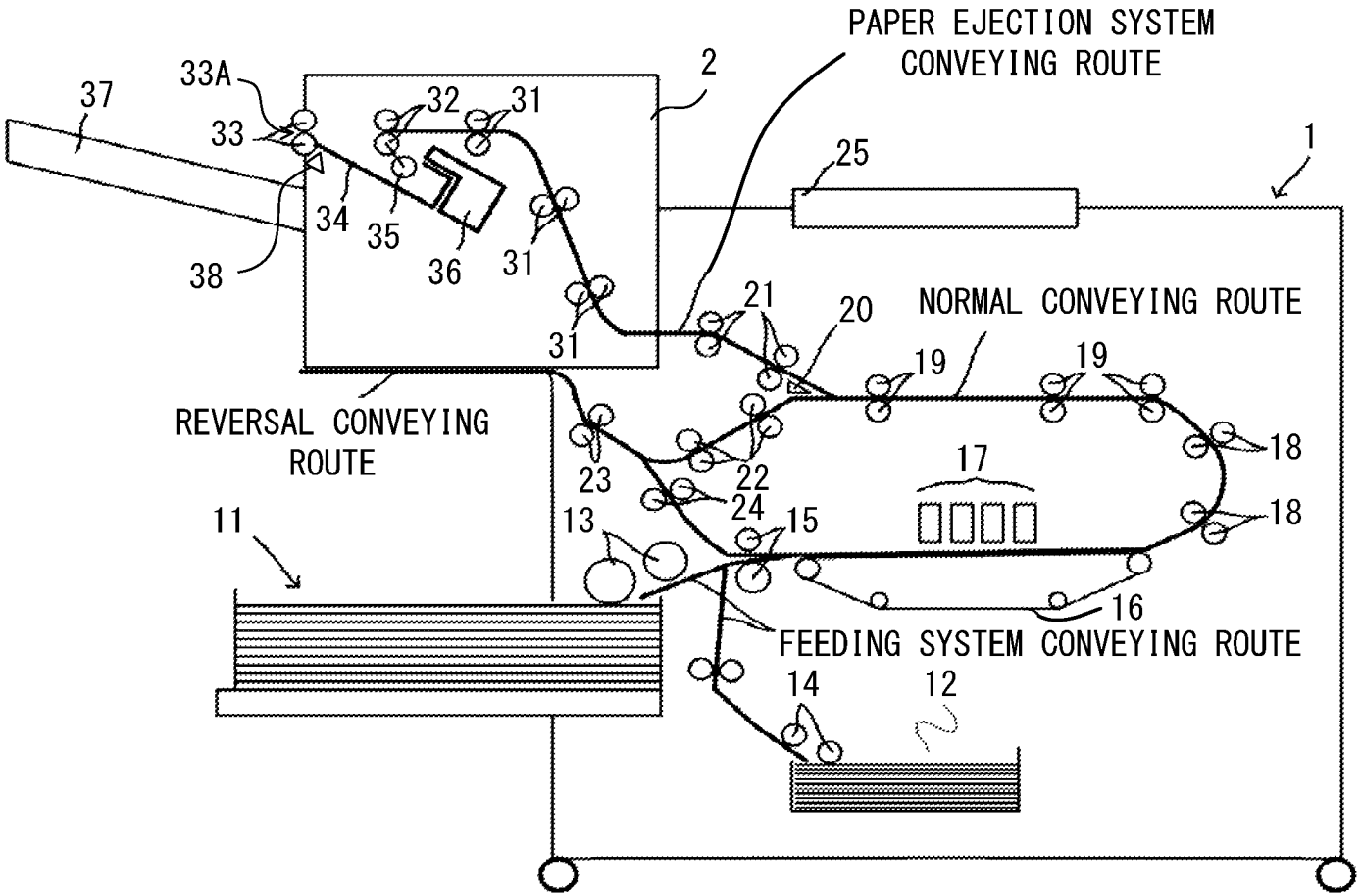
FIG. 1 illustrates an internal configuration of a printing device according to embodiments.

Embodiments of the present invention are described below with reference to the drawings. FIG. 1 illustrates an internal configuration of an ink-jet printer (hereinafter simply referred to as a "printer") 1 as an example of a printing device. To the printing device, an arbitrary printing device other than the ink-jet printer can be applied. The printing device may be, for example, a stencil printing machine or a laser printer.

In addition, FIG. 1 illustrates a configuration in which a paper sheet ejector device 2 is connected as an optional device to the printer 1, but rather than the paper sheet ejector device 2, a mere paper sheet eject tray may be provided to the printer 1.

The printer 1 is a device that prints a prescribed image, character, illustration, or the like on a paper sheet. The paper sheet ejector device 2 is a device that performs prescribed post-processing on the paper sheet on which the printer 1 has performed printing, and ejected the paper sheet. The paper sheet ejector device 2 is detachably connected to the printer 1.

The printer 1 includes a paper sheet feeding unit 11, an internal paper sheet feeding base 12, external paper sheet feeding rollers 13, internal paper sheet feeding rollers 14, resist rollers 15, a conveying belt 16, a printing unit 17, upward conveyor rollers 18, horizontal conveyor rollers 19, a switching unit 20, ejected paper conveyor rollers 21, reversal conveyor rollers 22, reversal rollers 23, paper sheet re-feeding rollers 24, and a display unit 25. In addition, the printer 1 includes a paper sheet feeding system conveying route FR, a normal conveying route CR, a paper sheet ejecting system conveying route DR, and a reversal conveying route SR.

The paper sheet feeding unit 11 stacks paper sheets used for the printing. In this example, a portion of the paper sheet feeding unit 11 is provided so as to be exposed externally from the printer 1. The internal paper sheet feeding base 12 also stacks paper sheets used for the printing. In this example, the internal paper sheet feeding base 12 is provided inside the printer 1. The paper sheet feeding unit 11 and the internal paper sheet feeding base 12 function as a paper sheet feeding means that feeds paper sheets.

The external paper sheet feeding rollers 13 pick out one paper sheet at a time from the paper sheet feeding unit 11, and convey the paper sheet toward the resist rollers 15 along the paper sheet feeding system conveying route FR. The internal paper sheet feeding rollers 14 similarly pick out one paper sheet at a time from the internal paper sheet feeding base 12, and convey the paper sheet toward the resist rollers 15 along the paper sheet feeding system conveying route FR.

The resist rollers 15 temporarily stop the paper sheet conveyed from the external paper sheet feeding rollers 13, the internal paper sheet feeding rollers 14, and the paper sheet re-feeding rollers 24. Then, the resist rollers 15 perform skew correction, and convey the paper sheet toward the conveying belt 16 and the printing unit 17.

The conveying belt 16 is arranged at a downstream side of the resist rollers 15, and conveys the paper sheet conveyed by the resist rollers 15 while sucking the paper sheet on a conveying surface formed on a surface of the conveying belt 16. The conveying belt 16 is an annular endless belt stretched around driving rollers and driven rollers.

Multiple belt holes (not illustrated) that are through-holes for sucking and holding a paper sheet are formed in the conveying belt 16. The conveying belt 16 driven by the driving rollers rotating in a clockwise direction in FIG. 1 so as to convey the sucked paper sheet and is held on the conveying surface in a rightward direction in FIG. 1.

The printing unit 17 is arranged at an upper portion of the conveying belt 16, and includes a line type ink-jet head in which a plurality of nozzle arrays are arranged in a direction substantially orthogonal to a conveying direction of a paper sheet. The printing unit 17 discharges ink from nozzles of the ink-jet head to the paper sheet conveyed by the conveying belt 16, and prints an image.

The upward conveyor rollers 18 convey the paper sheet that has been received from the conveying belt 16 and on which the printing has been performed by the printing unit 17, in an upward direction in FIG. 1 toward the horizontal conveyor rollers 19, while nipping the paper sheet.

The horizontal conveyor rollers 19 convey the paper sheet received from the upward conveyor rollers 18 from a rightward direction to a leftward direction in FIG. 1 while nipping the paper sheet. The horizontal conveyor rollers 19 are arranged along the normal conveying route CR.

The switching unit 20 is configured to switch a conveying route of the paper sheet between the paper sheet ejecting system conveying route DR and the reversal conveying route SR. The switching unit 20 is arranged at a diverging point between the paper sheet ejecting system conveying route DR and the reversal conveying route SR.

For example, when duplex printing is formed on a paper sheet, the switching unit 20 performs switching so as to convey a simplex printed paper sheet toward the reversal conveying route SR. Then, the reversal conveyor rollers 22 convey the paper sheet switched by the switching unit 20 from the normal conveying route CR toward the reversal rollers 23.

The reversal rollers 23 temporarily bring in the simplex printed paper sheet along the reversal conveying route SR, bring out the simplex printed paper sheet, and convey the paper sheet toward the paper sheet re-feeding rollers 24. The reversal rollers 23 are arranged on the reversal conveying route SR. The reversal conveying route SR is a space for temporarily bringing in a paper sheet. The reversal conveying route SR is provided below the paper sheet eject device 2.

The paper sheet re-feeding rollers 24 convey the paper sheet conveyed by the reversal rollers 23 toward the resist rollers 15. The paper sheet re-feeding rollers 24 are arranged on a route formed by the reversal rollers 23 and the resist rollers 15. The paper sheet reversed by the reversal rollers 23 is conveyed from the resist rollers 15 to the conveying belt 16 with an unprinted surface facing upward. Then, the paper sheet, on which printing is performed on its unprinted surface by the printing unit 17, is conveyed through the upward conveyor rollers 18 and the horizontal conveyor rollers 19.

In addition, in a case in which a paper sheet created by simplex printing or duplex printing is ejected, when the paper sheet reaches the switching unit 20 in the normal conveying route CR, a conveying route is switched to the paper sheet ejecting system conveying route DR, and the paper sheet is conveyed from the switching unit 20 while being nipped by the paper sheet ejecting conveyor rollers 21. The paper sheet conveyor roller ejecting conveyor rollers 21 receive the paper sheet from the horizontal conveyor rollers 19, and convey the paper sheet toward the paper sheet eject device 2 while nipping the paper sheet.

The display unit 25 is a panel that operates on the basis of an instruction from a user in the printer 1, and is provided on an upper surface of the printer device. The display unit 25 may adopt a touch panel display system, and in this case, a user can input prescribed information into the printer 1 using the display unit 25.

Described next is a configuration of the paper sheet eject device 2. The paper sheet eject device 2 is connected to the printer 1, and a paper sheet on which printing processing has been performed is conveyed to the paper sheet eject device 2 along the paper sheet ejecting system conveying route DR. The paper sheet eject device 2 includes post-processing conveyor rollers 31, paper sheet ejecting rollers 32, reversal conveying-out rollers 33, a supporting member 34, a post-processing delivery roller 35, a post-processing unit 36, a stacking base 37, and a sensor 38.

A paper sheet conveyed along the paper sheet ejection system conveying route DR of the printer 1 is received by the post processing conveyor rollers 31, and is conveyed. In addition, the paper sheet ejecting rollers 32 nip the paper sheet from the post-processing conveyor rollers 31. Then, the reversal conveyor rollers 33 receive the paper sheet from the paper sheet stack rollers 32, and eject one paper sheet at a time onto the stacking base 37. As a result, the ejected paper sheets are stacked on the stacking base 37.

Accordingly, a position of the reversal conveyor rollers 33 is a paper sheet ejecting opening 33A to eject a paper sheet. Of course, in a mechanism other than the mechanism illustrated in FIG. 1, the paper sheet ejecting opening 33A may be provided in a different position.

Near the reversal conveying-out rollers 33, the sensor 38 is provided. The sensor 38 is a sensor that detects the paper sheet ejected from the paper sheet ejecting opening 33A. The sensor 38 is provided in order to detect whether the stacking base 37 is in a full-stack state. Therefore, the sensor 38 may be provided near a position in which the stacking base 37 enters into the full-stack state.

In addition, when post-processing, such as staple processing or punching processing, is performed on a paper sheet, the paper sheet is ejected to the supporting member 34, and is delivered to the post-processing unit 36 by the post-processing delivery roller 35. On the paper sheet delivered to the post-processing unit 36, the post processing such as the staple processing or the punching processing is performed. In some cases, the post-processing unit 36 does not perform processing.

Figure 2:
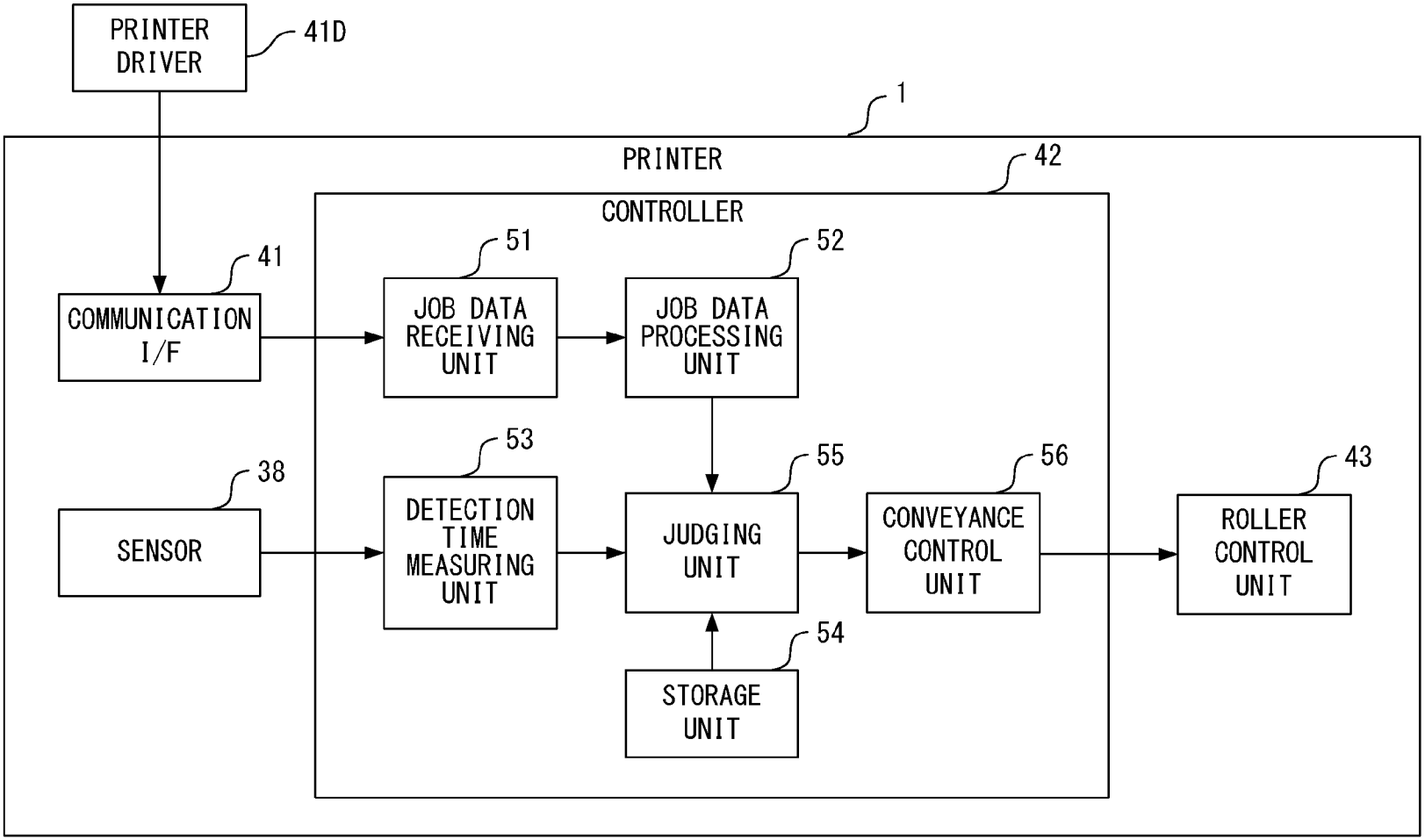
FIG. 2 is a functional block diagram for performing the control according to the embodiments.

With reference to FIG. 2, a functional block diagram for performing the control according to the present embodiments is described next. The conveyance control apparatus is configured by respective components illustrated in FIG. 2. The printer 1 includes the sensor 38 described above, a communication interface (illustrated as a "communication I/F" in FIG. 2) 41, a controller 42, and a roller control unit 43.

The sensor 38 detects a paper sheet ejected to the stacking base 37 as described above. The communication interface 41 is an interface that communicates data with a network, when the printer 1 is connected to the network.

When the printer 1 is connected to the network, printing data is output from an information processing terminal (e.g., a personal computer) connected to the network. The printing data is controlled by a printer driver 41D of the information processing terminal.

In the example illustrated in FIG. 2, the printing data is input from the communication interface 41 to the printer 1 by the printer driver 41D via the network. The printing data may be input into the printer 1 with a method other than the network. For example, a user may connect a portable external storage device (e.g., an external memory) to the printer 1, and input the printing data into the printer 1.

Described next is the controller 42. The controller 42 is mounted on the printer 1, and includes, for example, a CPU (Central Processing Unit), a RAM (Random Access Memory), a ROM (Read Only Memory), an HDD (Hard Disk Drive), and the like. Each function of the controller 42 is performed by executing a prescribed program developed in the RAM.

The controller 42 includes a job data receiving unit 51, a job data processing unit 52, a detection time measuring unit 53, a storage unit 54, a judging unit 55, and a conveyance control unit 56. The controller 42 integrally controls each unit included in the printer 1. In the storage unit 54, plural pieces of information are stored. Therefore, the storage unit 54 may be configured of a plurality of storage devices, or a single storage device may be divided into regions and the regions may store the plural pieces of information.

The job data receiving unit 51 receives printing data from the communication interface 41. The printing data is job data of a printing job. The job data is input from the printer driver 41D of another information processing terminal connected to the network.

The job data processing unit 52 processes the job data received by the job data receiving unit 51. The job data includes paper sheet information, such as the number of paper sheets to be printed, and the number of paper sheets to be printed is decremented every time one paper sheet is printed. Then, pieces of job data of the number of paper sheets to be printed are managed as one job. The job data processing unit 52 outputs pieces of data regarding the number of remaining paper sheets to be printed of the one job to the judging unit 55 as the number of remaining paper sheets to be printed.

The detection time measuring unit 53 measures a time during which the sensor 38 detects a paper sheet. When the sensor detects the paper sheet, the sensor 38 is turned on. The detection time measuring unit 53 measures a time during which the sensor 38 is in an ON state.

Hereinafter, the time during which the sensor 38 is in the ON state is referred to as a "sensor-on time". When the sensor 38 is changed from ON to OFF, the sensor-on time is terminated. The sensor-on time is output to the judging unit 55.

The storage unit 54 stores various pieces of information. In this embodiment, the storage unit 54 stores a near-full-stack time, a full-stack time, and an expected-limit paper sheet number. Of course, the storage unit 54 may store information other than these pieces of information. For example, the storage unit 54 may store a third time as described below.

The near-full-stack time and the full-stack time are preset times, and the set near-full-stack time and full-stack time are stored in the storage unit 54. The near-full-stack time is a time for judging whether or not the number of paper sheet stacked on the stacking base 37 has reached the number of paper sheets in a near-full-(near full) stack state. The full-stack time is a time for judging whether the number of paper sheet stacked on the stacking base 37 has reached the number of paper sheets in a full-stack state. Accordingly, "near-full-stack time<full-stack time" is established.

The expected-limit paper sheet number is a theoretical value indicating the number of remaining paper sheets that can be ejected after a stacking amount of a paper sheet stacked on the stacking base 37 enters into the near-full-(near-full) stack state. The job data includes information such as a type of paper sheet and the expected-limit paper sheet number is obtained on the basis of the information such as the type of paper sheet. The expected-limit paper sheet number is stored in the storage unit 54.

The judging unit 55 judges whether the sensor-on time that the detection time measuring unit 53 measures is equal to or greater than the near-full-stack time. When the judging unit 55 judges that the sensor-on time is equal to or greater than the near-full-stack time, the judging unit 55 judges that the stacked volume enters into the near-full state.

In addition, the judging unit 55 judges whether the sensor-on time that the detection time measuring unit 53 measures is equal to or greater than the full-stack time. When the judging unit 55 judges that the sensor-on time is equal to or greater than the full-stack time, the judging unit 55 judges that the stacked volume enters into the full-stack state.

Further, the judging unit 55 compares the number of remaining paper sheets to be printed input from the job data processing unit 52 with the expected-limit paper sheet number stored in the storage unit 54. Then, the judging unit 55 judges whether the number of remaining paper sheets of a job that the number of remaining paper sheets to be printed indicates is equal to or less than the expected-limit paper sheet number.

Various results that the judging unit 55 judges are used for controlling the conveyance control unit 56. Namely, the conveyance control unit 56 controls a conveyance method on the basis of the judging results from the judging unit 55. Here, the conveyance control unit 56 judges one of a first conveyance control and a second conveyance control on the basis of the judging results.

The conveyance control unit 56 controls the roller control unit 43. The roller control unit 43 controls the drive of various rollers illustrated in FIG. 1 under the control of the conveyance control unit 56. As a result, conveyance control is performed.

The conveyance control unit 56 causes the roller control unit 43 to control the various rollers to rotate, and thereby paper sheets fed from the paper sheet feeding unit 11 are conveyed inside the printer 1, are ejected from the paper sheet ejecting opening 33A, and are stacked on the stacking base 37. On the other hand, control is performed to stop the various rollers so as to stop the paper sheet feeding and the paper sheet ejecting.

Figure 3:
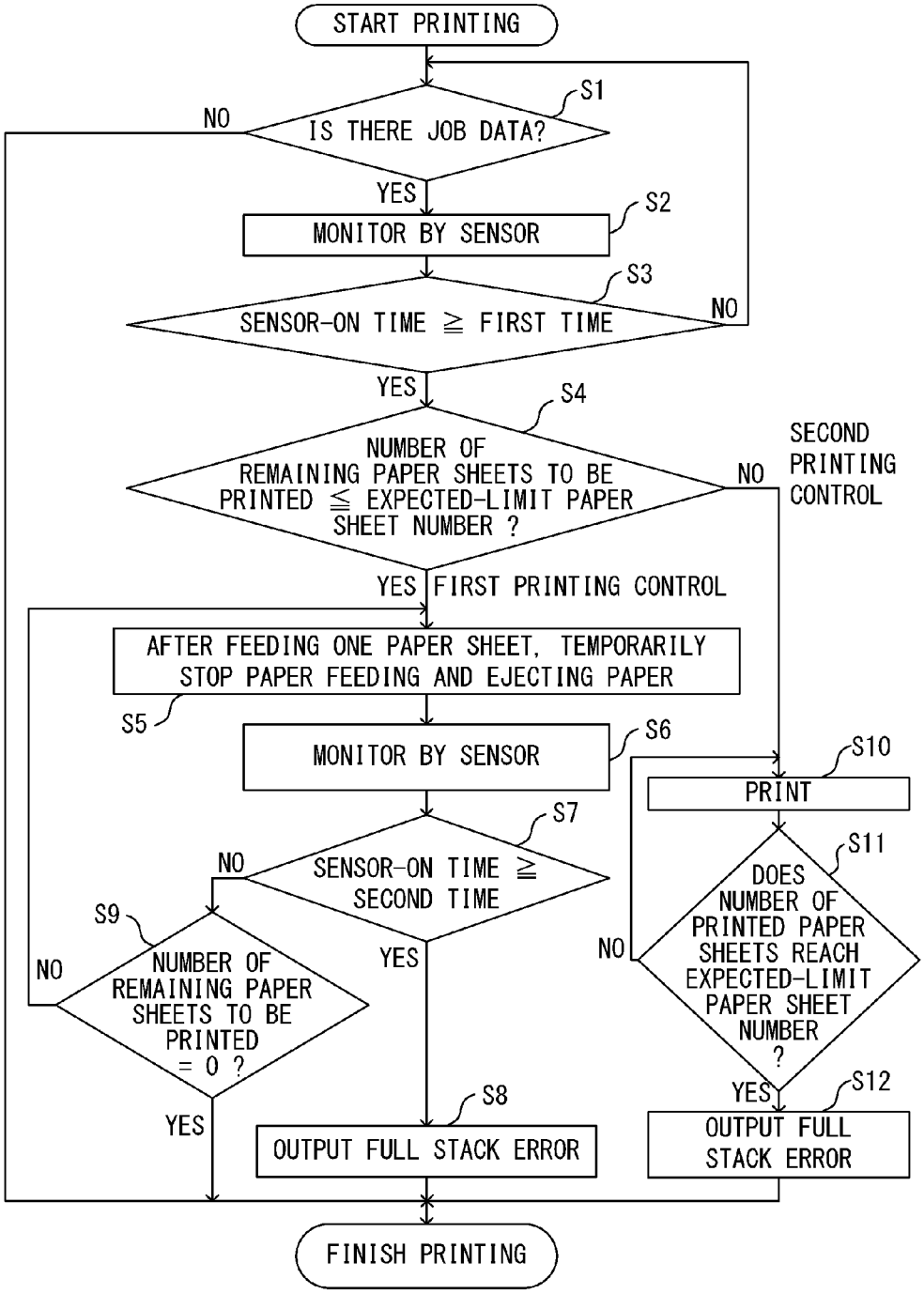
FIG. 3 is a flowchart for performing processing according to the embodiments.

Next, an operation is described with reference to the flowchart of FIG. 3. First, the controller 42 judges whether or not the job data exists (step S1). When the job data does not exist, no data to be printed exists, and therefore processing is finished.

On the other hand, when printing data is input from the printer driver 41D to the communication interface 41, the printing data (job data) is received by the job data receiving unit 51. The job data received by the job data receiving unit 51 is processed in the job data processing unit 52 as one printing job. The job data processing unit 52 performs processing so as to perform printing on the basis of the job data.

Namely, the paper sheet fed from the paper sheet feeding unit 11 is conveyed by the various rollers, printing is performed on the paper sheet by the printing unit 17, and the paper sheet is ejected from the paper sheet ejecting opening 33A of the paper sheet eject device 2. The ejected and printed paper sheet is stacked on the stacking base 37. At this time, the job data processing unit 52 decrements the number of remaining paper sheets to be printed every time one paper sheet is printed.

When the printed paper sheet is ejected from the paper sheet ejecting opening 33A of the paper sheet eject device 2, the paper sheet freely falls down toward the stacking base 37 due to gravity. Near the paper sheet ejecting opening 33A, the sensor 38 is provided, and detects the free falling of the paper sheet.

The sensor 38 has a prescribed detection range, and when the freely falling paper sheet is within the detection range, the sensor 38 detects the paper sheet. On this occasion, the sensor 38 is turned on. On the other hand, when the paper sheet is not within the detection range, the sensor 38 is turned off. Accordingly, the sensor 38 monitors whether or not the paper sheet is within the detection range (step S2).

Figure 4A:
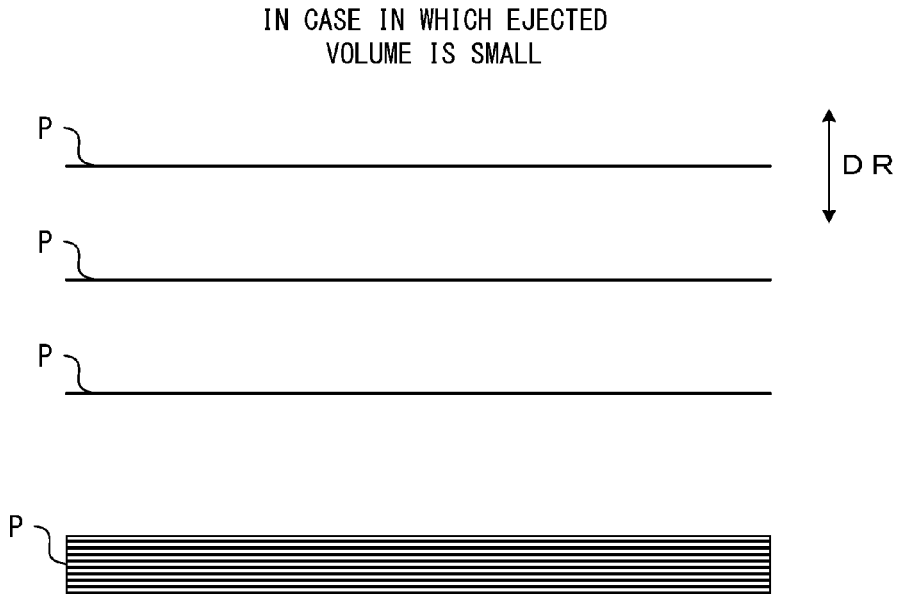
FIG. 4A and FIG. 4B are diagrams explaining a relationship between a falling paper sheet and a detection range.
Figure 4B:
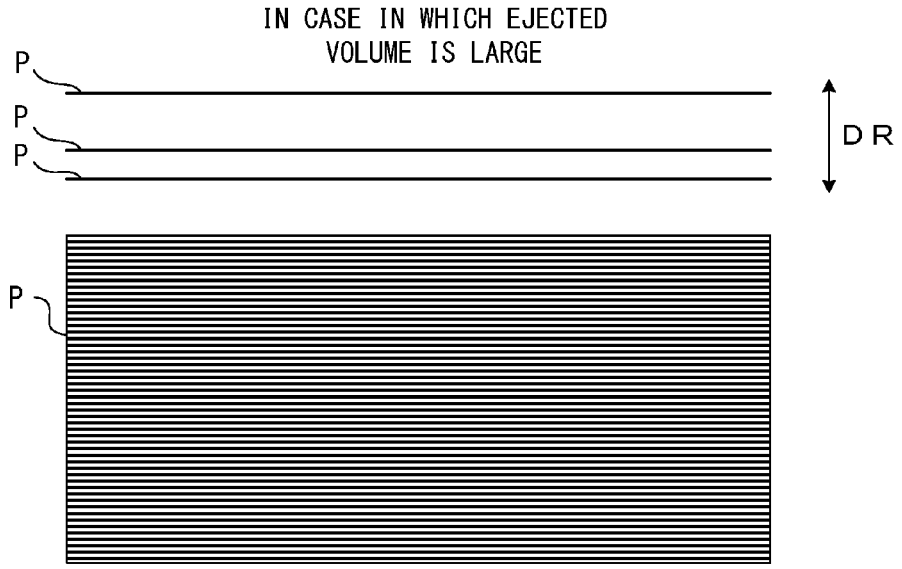

FIG. 4A and FIG. 4B schematically illustrate a relationship between a free fall of a paper sheet P and a detection range DR of the sensor 38 (a detection range in a falling direction of the paper sheet P). One paper sheet P at a time is ejected from the paper sheet ejecting opening 33A at a fixed speed, and the ejected paper sheet P freely falls.

As illustrated in FIG. 4A, when the stacked volume is small, the freely falling paper sheet P falls at a comparatively high speed because the paper sheet P is not strongly influenced by air resistance or the like. Accordingly, a time during which the paper sheet P is within the detection range DR (a time during which the sensor 38 detects the paper sheet P: a sensor-on time) is short.

On the other hand, as illustrated in FIG. 4B, when the stacking amount is large, the free falling paper sheet P is strongly influenced by the air resistance or the like, and therefore a falling speed is decreased. As a result, a speed at which the paper sheet P falls becomes low. Then, because the paper sheets are continuously ejected from the paper sheet ejecting opening 33A at a fixed speed, a plurality of paper sheets P are within the detection range DR. Therefore, the sensor-on time becomes longer.

Namely, even when the paper sheet P positioned at the bottom deviates from the detection range DR, the following paper sheet P, a new paper sheet P, and the like, are within the detection range DR. As a result, the sensor 38 is always in the ON state, and the sensor-on time becomes longer.

As described above, the storage unit 54 stores the near-full-stack time. The near-full-stack time is a time for judging whether the number of paper sheets stacked on the stacking base 37 has reached the number of paper sheets in the near-full-stack state (near-full). When the stacked volume of the stacking base 37 reaches the near-full state, the falling speed of the paper sheet P ejected from the paper sheet ejecting opening 33A becomes low.

Therefore, the sensor-on time during which the sensor 38 detects the paper sheet P becomes longer. The near-full-stack time stored in the storage unit 54 is a sensor-on time when the volume of the stacking base 37 reaches the near-full state.

The judging unit 55 compares the sensor-on time that the detection time measuring unit 53 detects (a time during which the sensor 38 is in the ON state) with the near-full-stack time (step S3). When the stacked volume of the paper sheet P on the stacking base 37 is small, the sensor-on time is short. Accordingly, in step S3, the judging unit 55 judges NO, and the process returns to step S1.

The paper sheets P are continuously ejected from the paper sheet ejecting opening 33A, and therefore as the number of paper sheets to be printed in the job data becomes larger, the volume on the stacking base 37 is increased. In addition, due to the influence of the air resistance or the like, the sensor-on time becomes longer. Accordingly, when the sensor-on time reaches the near-full-stack time (YES in step S3), the judging unit 55 judges that the stacked volume on the stacking base 37 is in the near-full state.

When the judging result in step S3 is YES, namely, when the volume of the stacking base 37 reaches the near-full state, the judging unit 55 compares the number of remaining paper sheets to be printed with the expected-limit paper sheet number (step S4). Therefore, the judging unit 55 obtains the number of remaining paper sheets to be printed from the job data processing unit 52, and obtains the expected-limit paper sheet number from the storage unit 54.

The job data processing unit 52 decrements the number of paper sheets to be printed that is indicated by the job data every time one paper sheet is printed. Accordingly, the number of remaining paper sheets to be printed that the judging unit 55 obtains from the job data processing unit 52 is the number of remaining paper sheets to be printed when the stacked volume of the stacking base 37 is in the near-full state.

As described above, the storage unit 54 stores the expected-limit paper sheet number that is a theoretical value indicating how many paper sheets can be ejected after the stacking amount of the stacking base 37 enters the near-full state. Therefore, the judging unit 55 compares the number of remaining paper sheets to be printed with the expected-limit paper sheet number, and when the number of remaining paper sheets to be printed is equal to or smaller than the expected-limit paper sheet number (YES in step S4), the judging unit 55 judges that the first conveyance control should be performed.

On the other hand, when the number of remaining paper sheets to be printed exceeds the expected-limit paper sheet number (NO in step S4), the judging unit 55 judges that the second conveyance control should be performed.

When the judging unit 55 judges that the first conveyance control should be performed, after only one paper sheet P is fed from the paper sheet feeding unit 11, the paper sheet feeding and the paper sheet ejecting is temporarily stopped (step S5). For this purpose, the conveyance control unit 56 controls the roller control unit 43 such that the various rollers feed only one paper sheet and the paper sheet feeding temporarily stops. As a result, the feeding and discharging of the paper sheet P is temporarily stopped.

The sensor 38 monitors whether the paper sheet P is within the detection range DR (step S6), and when the paper sheet P is within the detection range DR, the sensor 38 is turned on. As described above, when the stacking amount of the stacking base 37 is in the near-full state, the paper sheet P is strongly influenced by air resistance or the like. Therefore, the falling speed of the paper sheet P becomes low, and a plurality of paper sheets P always exist within the detection range DR of the sensor 38. Accordingly, the sensor-on time of the sensor 38 becomes longer.

In the first conveyance control, the conveyance control unit 56 controls the roller control unit 43 to stop the various rollers so as to temporarily stop the paper sheet feeding and the paper sheet ejecting. As a result, the paper sheet P is temporarily not stacked from the paper sheet stack opening 33A.

Immediately after the paper sheet feeding and the paper sheet ejecting are temporarily stopped, the sensor 38 is put in the ON state because a plurality of paper sheets P are within the detection range DR. However, a new paper sheet P is not ejected, and therefore the plurality of paper sheets P within the detection range DR deviate from the detection range DR afterward.

As a result of this, the sensor 38 is changed from ON to OFF. On the other hand, when the paper sheet P stacked on the stacking base 37 enters into the full-stack state, the sensor 38 still detects the ON state even when the paper sheet feeding and the paper sheet ejecting are temporarily stopped. As described above, the storage unit 54 stores the full-stack time. The full-stack time is a time for judging whether the number of paper sheets stacked on the stacking base 37 has reached the number of paper sheets in the full-stack state.

Therefore, the judging unit 55 obtains the full-stack time stored in the storage unit 54, and obtains the sensor-on time from the detection time measuring unit 53. Then, the judging unit 55 compares the full-stack time with the sensor-on time (step S7).

When the sensor-on time is equal to or greater than the full-stack time (YES in step S7), the number of paper sheets stacked on the stacking base 37 is the number of paper sheets in the full-stack state. Accordingly, the controller 42 judges that the stacking base 37 is in the full-stack state, and outputs a warning which indicates that this state is a full stack error (step S8). When the full stack error is output, a user removes the paper sheets P from the stacking base 37. As a result, the printing can be resumed.

On the other hand, in step S7, when the judging unit 55 judges that the sensor-on time is shorter than the full-stack time, the paper sheets stacked on the stacking base 37 do not reach the full-stack state. Namely, although the sensor-on time is longer than the near-full-stack time for judging that the stacked volume is in the near-full state, the state of the sensor 38 is changed from ON to OFF before the sensor-on time reaches the full-stack time for judging that the stacked volume is in the full-stack state.

This is because the conveyance control unit 56 controls the roller control unit 43 to temporarily stop the paper sheet feeding and ejecting. As described above, when the paper sheets are continuously fed, a state in which a plurality of paper sheets P are within the detection range DR is continued, and therefore the sensor-on time is continued. Accordingly, when the paper sheet feeding and ejecting are not temporarily stopped, the sensor-on time exceeds the full-stack time even when the stacking amount does not actually reach the full-stack state. Namely, although paper sheets can actually still be ejected on the stacking base 37, it is judged that the stacking base 37 is in the full-stack state, and the printing is interrupted.

Then, in step S5, the paper sheet feeding and the paper sheet stack are temporarily stopped. As a result, the sensor 38 does not detect the paper sheet P, and the sensor 38 is turned off. Therefore, because the sensor-on time becomes shorter than the full-stack time, the judging unit 55 does not judge that the stacking base 37 is in the full-stack state.

When the judging result in step S7 is NO, namely, when the sensor-on time is shorter than the full-stack time, the judging unit 55 judges that the stacking base 37 is not in the full-stack state, and one paper sheet at a time is printed. First, the judging unit 55 obtains the number of remaining paper sheets to be printed from the job data processing unit 52. Then, the judging unit 55 judges whether the number of remaining paper sheets to be printed is zero (step S9).

Remaining paper sheets to be printed is zero means that the printing job is completed. Accordingly, in this case (YES in step S9), the printing process is finished. Namely, the printing job is completed before the stacking base 37 enters into the full-stack state. On the other hand, when the number of remaining paper sheets to be printed is not zero (NO in step S9), namely, when the number of remaining paper sheets to be printed is one or more, the process returns to step S5.

As described above, in step S5, after only one paper sheet is fed from the paper sheet feeding unit 11, the paper sheet feeding and ejecting are temporarily stopped. Therefore, one paper sheet at a time is fed and ejected. Namely, the processes of step S5 to step S9 (the first conveyance control) are repeated.

Accordingly, when the judging unit 55 judges that the sensor-on time is equal to or exceeds the near-full-stack time and is shorter than the full time, control is performed such that only one paper sheet is fed from the paper sheet feeding unit 11 and the paper sheet feeding and the paper sheet ejecting are temporarily stopped.

As a result of this, it can be judged whether the paper sheets P are in a full stack on the stacking base 37, regardless of a type of paper sheet, without calculating a pulse width. Namely, because one paper sheet at a time is ejected while the paper sheet feeding and ejecting are temporarily stopped, it can be judged accurately whether the stacking base 37 has reached the full state even when the paper sheet is influenced by air resistance or the like.

The first conveyance control has been described above. In step S4, when the number of remaining paper sheets to be printed exceeds the expected-limit paper sheet number (NO in step S4), the second conveyance control is performed. When the number of remaining paper sheets to be printed exceeds the expected-limit paper sheet number, it is judged that the stacking base 37 enters into the full-stack state when the remaining paper sheets of the printing job are printed.

Therefore, the paper sheet feeding and ejecting are not temporarily stopped, and the normal printing continues to be performed (step S10). Then, the printing is performed until the number of printed paper sheets reaches the expected-limit paper sheet number (step S11), and when the number of printed paper sheets reaches the expected-limit paper sheet number, a full stack error is output (step S12). By outputting the full stack error, a user is warned to remove the paper sheet P from the stacking base 37, and after the user removes the paper sheets P from the stacking base 37, the printing is resumed.

Accordingly, in the second conveyance control, control is not performed so as to temporarily stop the paper sheet feeding and ejecting as in the first conveyance control, the normal printing is performed, and the full stack error is output when the number of printed paper sheets reaches the expected-limit paper sheet number.

As described above, in step S4, when the judging unit 55 judges that the number of remaining paper sheets to be printed is equal to or lower than the expected-limit paper sheet number, the first conveyance control is performed in which the paper sheet feeding and ejecting are temporarily stopped, and when the judging unit 55 judges that the number of remaining paper sheets to be printed exceeds the expected-limit paper sheet number, the second conveyance control is performed in which the paper sheet feeding and ejecting are not temporarily stopped.

Figure 5A:
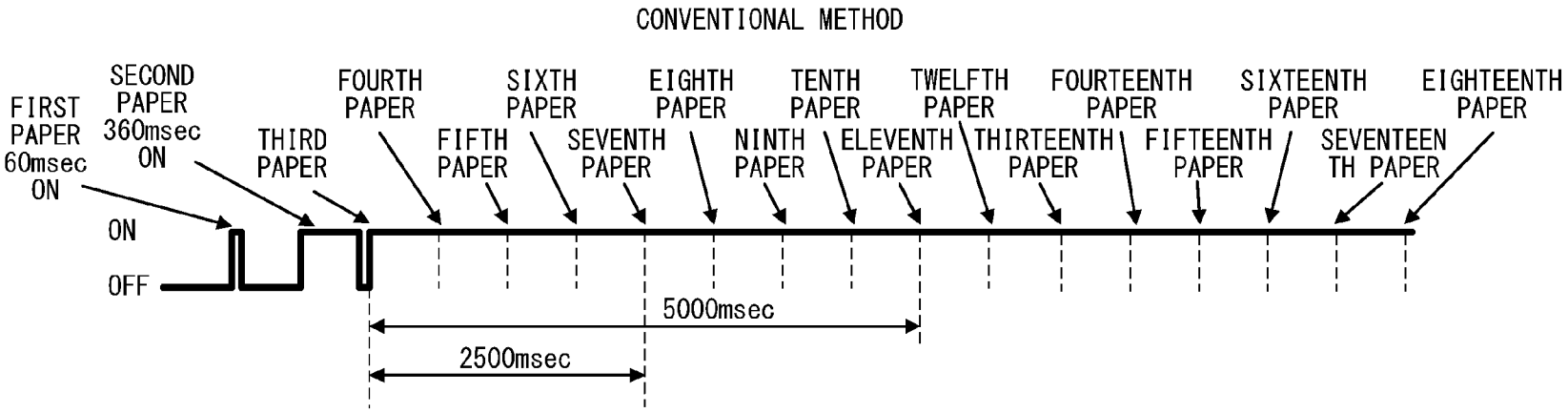
FIG. 5A and FIG. 5B illustrate rectangular waves that compare a conventional method and a method according to the present embodiments.
Figure 5B:
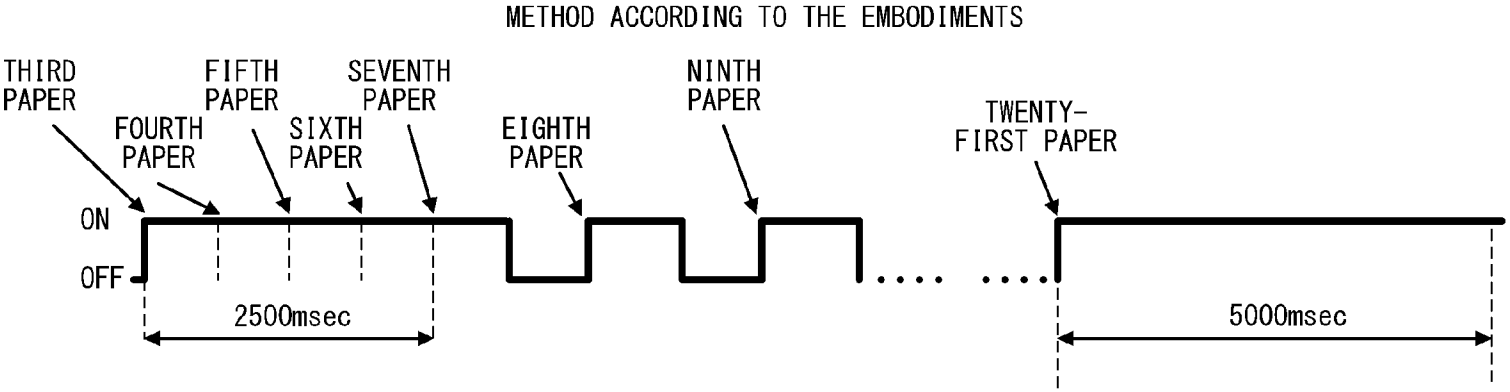

Next, with reference to FIG. 5, a conventional method and the method according to the embodiments are compared. FIG. 5A illustrates a rectangular wave of the sensor 38 in the conventional method, and FIG. 5B illustrates a rectangular wave in the method according to the present invention. When the stacking amount is small, the paper sheet P is not strongly influenced by the air resistance or the like, and therefore the sensor 38 is turned off immediately after the sensor 38 is turned on. This state is illustrated as a first paper sheet in FIG. 5A. In this case, the sensor-on time is very short.

When the stacked volume is large, the falling speed of the paper sheet P is decreased due to the influence of the air resistance or the like. Accordingly, the sensor-on time of the sensor 38 becomes longer. This state is illustrated as a second paper sheet in FIG. 5A. However, at the time of the second paper sheet, the sensor 38 is changed from an ON state to an OFF state.

At the time of a third paper sheet or following paper sheets, the sensor 38 is continuously in the ON state. Here, assume that the near-full-stack time is 2500 msec and the full-stack time is 5000 msec. In the conventional method, because the sensor-on time is longer than 2500 msec, a near-full state is detected at the time of a seventh paper sheet.

In addition, because the sensor-on time is longer than 5000 msec, a full-stack state is detected at the time of an eleventh paper sheet. Therefore, in the conventional method, at the point in time of the eleventh paper sheet, a full stack error is output, and the printing is interrupted.

Next, the method according to the embodiments is illustrated in FIG. 5B. Assume that behavior up to a third paper sheet is the same as that in FIG. 5A. As illustrated in FIG. 5B, the sensor-on time is longer than 2500 msec, which is the full-stack time. Therefore, the judging unit 55 detects the near-full state. At this point in time, when the number of remaining paper sheets to be printed is larger than the expected-limit paper sheet number, only one paper sheet is fed, and the paper sheet feeding and ejecting are temporarily stopped. At this point in time, the stacked amount of the paper sheets on the stacking base 37 is in the near-full state, but is not in the full-stack state.

Accordingly, the conveyance control unit 56 controls the roller control unit 43 to stop the various rollers. As a result, the paper sheet feeding and ejecting are temporarily stopped. Therefore, because there are no newly ejected paper sheets P, the paper sheet P within the detection range DR of the sensor 38 deviates from the detection range DR, and the sensor 38 is turned off. Therefore, because, at a point in time of an eighth paper sheet in FIG. 5B, the sensor-on time is shorter than the full eject time, it is not judged that the stacking base is in the full-stack state, and it is judged whether the number of remaining paper sheets to be printed is zero.

When the number of remaining paper sheets to be printed is not zero, one paper sheet that has been fed previously, i.e., a ninth paper sheet, is ejected, and the paper sheet feeding and ejecting are temporarily stopped again. Then, as illustrated in FIG. 5B, the ninth paper sheet P deviates from the detection range DR of the sensor 38, and the sensor 38 is turned off again.

The operation above is repeated up to a twentieth paper sheet. At a point in time of a twenty-first paper sheet, the sensor 38 is continuously in the ON state even when the paper sheet feeding and ejecting are temporarily stopped. As illustrated in FIG. 5B, the sensor-on time exceeds 5000 msec, which is the full-stack time. Accordingly, at this point in time, it is judged that the stacking base is in the full-stack state, and the printing is interrupted.

As is obvious from FIG. 5A and FIG. 5B, in the conventional method, it is judged that the stacking base is in the full-stack state at the point in time of the eleventh paper sheet. As a result, after the printing of the eleventh paper sheet is finished, the printing is interrupted. On the other hand, in the method according to the embodiments, it is judged that the stacking base is in the full-stack state at a point in time of the twenty-first paper sheet. As a result, after the printing of the twenty-first paper sheet is finished, the printing is interrupted.

Accordingly, by performing the first conveyance control, it is judged simply and accurately whether the stacking base 37 is in the full-stack state, regardless of the type of paper sheet, without performing a complicated calculation. Consequently, in the method according to the embodiments, more paper sheets P can be printed, and the productivity can be improved more than in the conventional method.

Here, assume that in FIG. 5A and FIG. 5B, the number of remaining paper sheets to be printed is 15. In the conventional method, it is judged that the stacking base is in the full-stack state at a point in time of the eleventh paper sheet, and the printing is interrupted. Then, the full stack error is output, and the printing is not resumed until a user removes the paper sheets P from the stacking base 37.

On the other hand, in the method according to the embodiments, the printing can be performed until the twenty-first paper sheet is printed. Therefore, all of the remaining fifteen paper sheets to be printed are printed, and it is not judged that the stacking base is in the full stack state. Accordingly, the printing is not interrupted, and the printing job is completed.

In the conventional method, a user receives a warning due to a full stack error, and an operation to cause the user to remove the paper sheets P from the stacking base 37 is needed. Therefore, it takes much time to complete the printing job. On the other hand, in the method according to the embodiments, the full stack error does not occur. Therefore, the printing is not interrupted, and a time needed for completing the printing job is remarkably short.

Accordingly, compared with the conventional method, the method according to the embodiments enables greatly improved productivity. In addition, in the case as described above, the user needs to remove the paper sheets P in the conventional method, but in the method according to the embodiments, the printing job is completed, and therefore the paper sheets P do not need to be removed. Consequently, the user is not forced to perform extra work, such as the removal of the paper sheets P.

In addition, in step S4, the judging unit 55 judges that the first conveyance control is performed when the number of remaining paper sheets to be printed is equal to or smaller than the expected-limit paper sheet number, and that the second conveyance control is performed when the number of remaining paper sheets to be printed exceeds the expected-limit paper sheet number. Namely, the judging unit 55 switches the first conveyance control and the second conveyance control on the basis of the number of remaining paper sheets to be printed.

In the first conveyance control, it can be judged simply and accurately whether the paper sheets P stacked on the stacking base 37 reach the full-stack state, but the paper sheet feeding and ejecting need to be temporarily interrupted. Therefore, compared with a case of the continuous printing, a certain amount of time loss occurs.

In view of the foregoing, in step S4, the judging unit 55 performs control to perform the first conveyance control when the number of remaining paper sheets to be printed is equal to or smaller than the expected-limit paper sheet number, and to perform the second conveyance control when the number of remaining paper sheets to be printed exceeds the expected-limit paper sheet number.

When the number of remaining paper sheets to be printed exceeds the expected-limit paper sheet number, it is expected that the printing job being performed has reached the full-stack state. When it is expected that the printing job has reached the full-stack state, the printing job reaches the full-stack state even when the first conveyance control is performed, and therefore the productivity is reduced by the amount of the time loss described above. In this case, the second conveyance control, not the first conveyance control, is performed.

As described above, the first conveyance control and the second conveyance control are switched in accordance with the situation, and therefore the first conveyance control is performed when it is certain that the stacking base does not reach the full-stack state. As a result, when it is judged that the stacking base does not reach the full-stack state even when the remaining paper sheets to be printed are printed, it is judged accurately that the stacking base is not in the full-stack state, and therefore a user only has to fetch printed paper sheets loaded in the printing device.

A variation is described next. In the variation, when the first conveyance control is performed, the printing is performed during a prescribed time after it is judged that the stacking base is in the near-full state. The control above is described.

As described above, when the first conveyance control is performed, one paper sheet is fed, and the paper sheet feeding and ejecting are temporarily stopped. Accordingly, as described above, it is judged simply and accurately that the paper sheets P are in a full-stack state, but time loss occurs due to the temporary stoppage.

Figure 6:
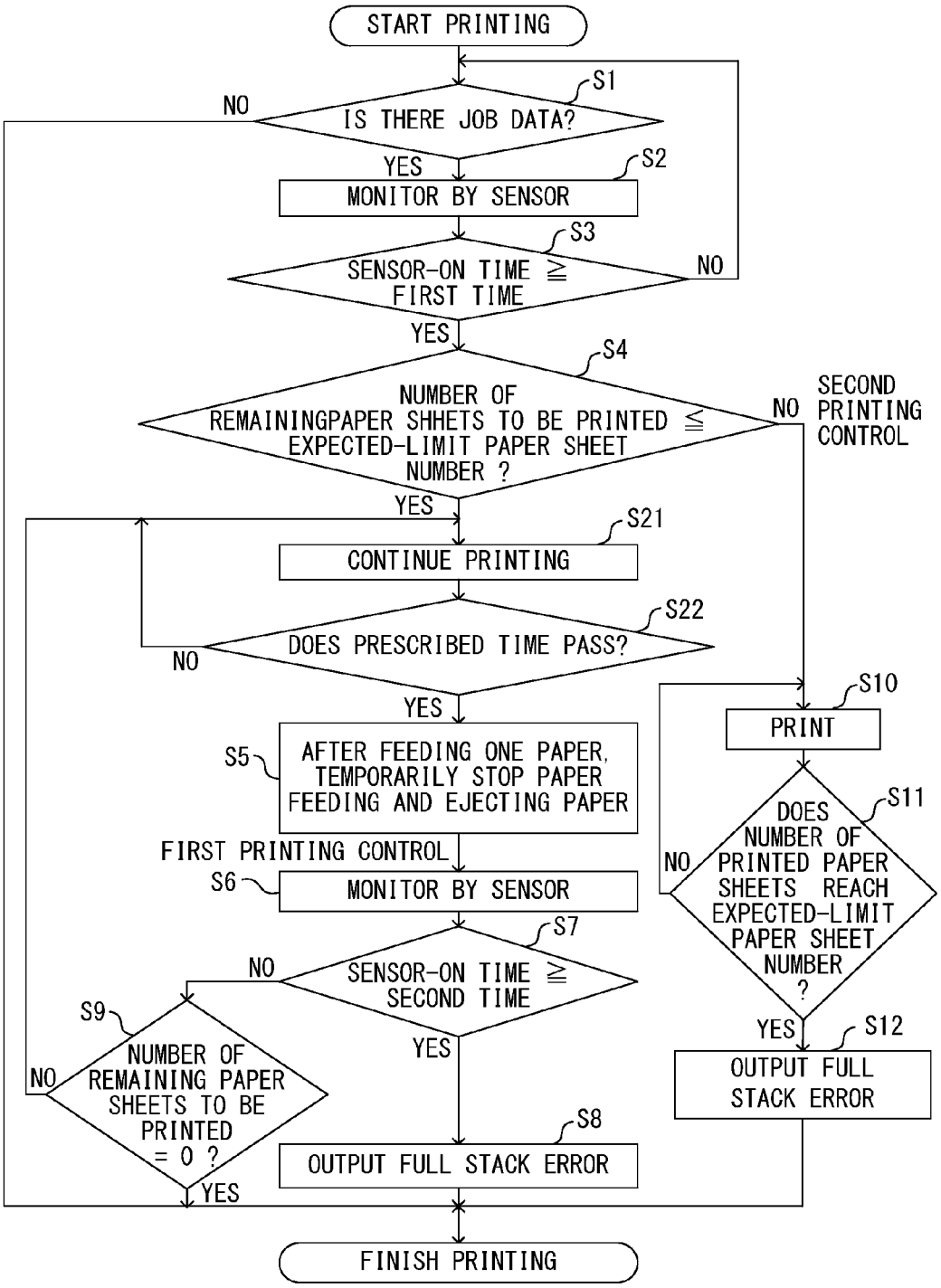
FIG. 6 is a flowchart for a variation of performing processing.

This variation enables shortening the time loss as much as possible. This variation is described with reference to the flowchart of FIG. 6. In the flowchart of FIG. 6, when the judging unit 55 judges that the first conveyance control should be performed, namely, when the judging unit 55 judges that the number of remaining paper sheets to be printed is equal to or smaller than the expected limit number paper sheet, the conveyance control unit 56 immediately feeds one paper sheet, and the normal printing is continued without temporarily stopping the paper sheet feeding and ejecting (step S21).

Namely, the paper sheets P are continuously ejected from the paper sheet ejecting opening 33A. Therefore, the sensor-on time becomes longer. Then, after the sensor-on time reaches the near-full time, the judging unit 55 judges whether the prescribed time has passed (step S22).

The prescribed time is a time between the near-full stacking time and the full-stack time. During the prescribed time, the normal printing in step S21 is performed. After the prescribed time passes, a process of step S5 of feeding one paper sheet is performed, and the paper sheet feeding and ejecting are temporarily stopped. The prescribed time can be stored in the storage unit 54. There is a specified time between the detection of the near-full state and the detection of the full-stack state is detected, and when the process of step S5 has been performed during the specified time, time loss due to the temporary stoppage becomes longer.

In view of this, the normal printing is performed after the near-full state is detected until the prescribed time passes, and after the prescribed time passes, the process of step S5 is performed. As a result, the influence of the time loss due to the temporary stoppage can be reduced.

For example, as illustrated in FIG. 5, when the near-full-stack time is 2500 msec and the full-stack time is 5000 msec, the prescribed time can be set to 4000 msec. The prescribed time can be arbitrarily set, but it is preferable that the prescribed time be set so as to be close to the full-stack time. By setting the prescribed time so as to be close to the full-stack time, a time of the continuous paper sheet ejection becomes longer, and the process time of the temporary stoppage in step S5 becomes shorter. Consequently, the productivity can be improved more greatly.

In the present embodiments, the first conveyance control is performed when it is judged that the sensor-on time of the sensor 38 is equal to or greater than the full-stack time and the number of remaining paper sheets to be printed is equal to or smaller than the expected-limit paper sheet number. However, the first conveyance control may be performed when the number of remaining paper sheets to be printed is equal to or greater than the expected-limit paper sheet number, and the second conveyance control may be performed when the number of remaining paper sheets to be printed is equal to or smaller than the expected-limit paper sheet number. As a result, in the first conveyance control, more paper sheets are stacked than in the second conveyance control, and the full-stack state is detected.

As described above, when the sensor-on time is equal to or greater than the near-full time during which the stacking base is in the near-full state, the paper sheet feeding is temporarily stopped. Consequently, even when the paper sheets are influenced by the air resistance or the like, the paper sheets deviate from the detection range of the sensor, and therefore it is judged accurately whether the stacking base is in the full-stack state, regardless of a stacking misalignment.

In addition, when it is judged that the stacking base enters into the full stack state if paper sheets are fed on the basis of the number of remaining paper sheets to be printed, control is performed so as to convey paper sheets of the remaining stackable number of paper sheets on the stacking base on the basis of an expected value in the near-full state without temporarily stopping the paper sheet feeding. Consequently, when it is expected that the stacking base will enter into the full-stack state, a user can quickly receive a report of the full-stack state.

In addition, by continuing the paper sheet feeding during a prescribed time after the near-full state, the time loss becomes shorter and printed paper sheets can be obtained earlier than in a case in which the paper sheet feeding is temporarily stopped immediately after the near-full time.

The embodiments of the present disclosure and the advantageous effects have been described above in detail. However, those skilled in the art can make various modifications, additions, or omissions without departing from a scope of the present invention specified in the claims.

What is claimed is:

1. A conveyance control apparatus comprising:

a stacking base that stacks ejected paper sheets;

a sensor that detects a paper sheet after the paper sheet is ejected according to job data before the paper sheet is stacked on the stacking base;

a detection time measuring unit that measures a sensor-on time during which the sensor detects the paper sheet;

a storage unit that stores (i) a near-full-stack time for judging whether or not a stacked volume on the stacking base enters a near-full-stack state and (ii) a full-stack time for judging whether or not the stacked volume on the stacking base enters a full-stack state;

a judging unit that judges a stack state on the stacking base based on paper sheet information of the job data and a measured result obtained by the detection time measuring unit; and a conveyance control unit that performs control to temporarily stop paper sheet feeding and to thereafter feed a predetermined number of paper sheets, when the judging unit judges that the sensor-on time is equal to or greater than the near-full-stack time and that the sensor-on time is shorter than the full-stack time.

2. The conveyance control apparatus according to claim 1, wherein the conveyance control unit performs conveyance control to not temporarily stop the paper sheet feeding when the judging unit judges that the sensor-on time is equal to or greater than the near-full-stack time and that the stacking base enters the full-stack state when paper sheet ejection is continued.

3. The conveyance control apparatus according to claim 1, wherein the conveyance control unit continues paper sheet feeding during a prescribed time after the sensor-on time is judged to be equal to or greater than the near-full-stack time before the paper sheet feeding is temporarily stopped.

* * * * *